US008967742B1

(12) United States Patent
Huewitt, Jr.

(10) Patent No.: US 8,967,742 B1
(45) Date of Patent: Mar. 3, 2015

(54) ROOF SHOE STORAGE ATTIC

(71) Applicant: Johnny L. Huewitt, Jr., Clearwater, FL (US)

(72) Inventor: Johnny L. Huewitt, Jr., Clearwater, FL (US)

( * ) Notice: Subject to any disclaimer, the term of this patent is extended or adjusted under 35 U.S.C. 154(b) by 0 days.

(21) Appl. No.: 13/890,021

(22) Filed: May 8, 2013

(51) Int. Cl.

| | |
|---|---|
| ***A47B 81/00*** | (2006.01) |
| ***A47F 5/08*** | (2006.01) |
| ***A47B 46/00*** | (2006.01) |
| ***A47F 7/08*** | (2006.01) |

(52) U.S. Cl.
CPC . *A47F 5/08* (2013.01); *A47B 46/00* (2013.01); *A47F 7/08* (2013.01)
USPC ..... 312/248

(58) Field of Classification Search
USPC ..... 52/39; 211/117, 85.29, 34, 35; 312/245, 312/246, 248, 249.7, 291, 300, 138.1, 212, 312/211, 117, 298, 327, 328
See application file for complete search history.

(56) References Cited

U.S. PATENT DOCUMENTS

| | | | | | |
|---|---|---|---|---|---|
| 1,592,119 | A | * | 7/1926 | Mclaughlin et al. | 312/313 |
| 2,655,424 | A | * | 10/1953 | O'Connor | 312/351 |
| 4,485,928 | A | * | 12/1984 | Staashelm | 211/35 |
| 4,588,216 | A | * | 5/1986 | Hinds | 292/113 |
| 4,660,725 | A | * | 4/1987 | Fishman et al. | 206/509 |
| 4,699,437 | A | * | 10/1987 | Genereaux | 312/248 |
| 4,795,029 | A | | 1/1989 | Campbell et al. | |
| 5,460,280 | A | * | 10/1995 | Feddeler | 211/116 |
| 5,475,949 | A | | 12/1995 | McCoy | |
| 5,649,751 | A | * | 7/1997 | Longhurst | 312/242 |
| 5,725,293 | A | | 3/1998 | Wilkening et al. | |
| 5,772,295 | A | * | 6/1998 | Sundmark | 312/246 |
| D400,383 | S | | 11/1998 | Fricano et al. | |
| 5,845,979 | A | * | 12/1998 | Longhurst et al. | 312/246 |
| 5,954,410 | A | * | 9/1999 | Noellert | 312/242 |
| 6,088,239 | A | | 7/2000 | Zeiss | |
| 6,354,682 | B1 | * | 3/2002 | Nott et al. | 312/248 |
| 6,550,878 | B2 | | 4/2003 | Nott et al. | |
| 6,719,157 | B2 | * | 4/2004 | Stoddart et al. | 211/118 |
| 6,732,858 | B1 | | 5/2004 | Chang Ou | |
| D584,053 | S | | 1/2009 | Abdo et al. | |
| 2002/0175166 | A1 | * | 11/2002 | Robinson et al. | 220/500 |
| 2006/0197419 | A1 | * | 9/2006 | Sorensen | 312/245 |
| 2009/0284110 | A1 | * | 11/2009 | Mascari | 312/242 |

FOREIGN PATENT DOCUMENTS

| | | | |
|---|---|---|---|
| FR | 2605506 | * | 4/1988 |
| JP | 08049403 | * | 2/1996 |

* cited by examiner

*Primary Examiner* — Janet M Wilkens

(57) ABSTRACT

A shoe storage system disposed on ceiling or roof. The system comprises a multiple compartment shoe attic and a mounting base. The mounting base has a base board and two flanges. The base board is attached on a ceiling via a plurality of mounting rod through mounting holes. The shoe attic is pivotably attached to the mounting base via two mounting hinges on both flanges. The shoe attic comprises a plurality of storage compartment with each compartment for a pair of shoes. Each compartment has a clear plastic door pivotably attached to the compartment via a door hinge disposed on the top the compartment. The shoe attic can be moved between a storage position hidden within the mounting base and deployed position. The attic comprises a handle for the convenience of user grip when a user moves the attic from storage position to deployed position.

1 Claim, 3 Drawing Sheets

(ISO View)

(Side View)

(Front View)

(In-use View)

(Back View)

ROOF SHOE STORAGE ATTIC

FIELD OF THE INVENTION

The present invention is related to a shoe storage attic, and more particularly to a shoe storage attic disposed on ceiling or roof.

BACKGROUND OF THE INVENTION

Many people found find that they have limited floor storage to store their shoes. One solution is to put all uncommonly used shoes into one large storage box. However, it would be difficult to quickly find a particular pair of shoes when needed and some shoes cannot be protected when many shoes arc stored together within one container. Hence, there is a need for an organized shoe storage without occupying excessive floor space.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a shoe storage system disposed on ceiling or roof. The system comprises a multiple compartment shoe attic and a mounting base. The mounting base has a base board and two flanges. The base board is attached on a ceiling via a plurality of mounting rods through mounting holes. The shoe attic is pivotably attached to the mounting base via two mounting hinges disposed on both flanges. The shoe attic comprises a plurality of storage compartments with each compartment for a pair of shoes. Each compartment has a clear plastic door pivotably attached to the compartment via a door hinge disposed on the top the compartment. The shoe attic can be moved between a storage position and deployed position. At storage position, the attic is hidden within the mounting base and secured by a secure means. The attic also comprises a handle for the convenience of user grip when a user moves the attic from storage position to deployed position. In some embodiments, see through windows disposed on the shoe attic (110) allow for viewing of the contents when the system is in the stored position.

DESCRIPTION OF PREFERRED EMBODIMENTS

Figure 1:
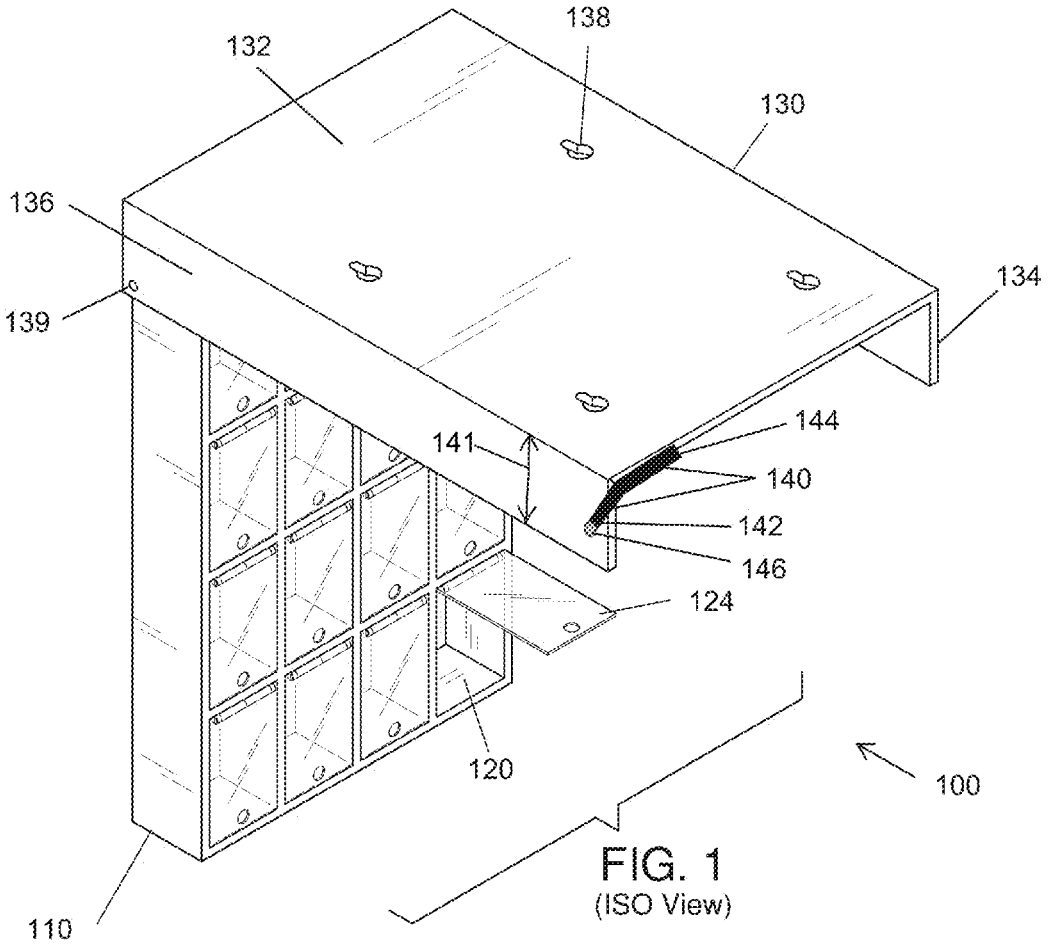
FIG. 1 shows an isometric view of the shoe storage system.
Figure 2:
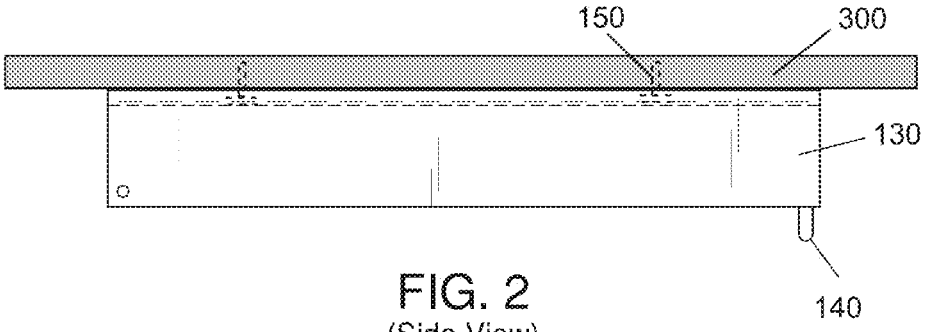
FIG. 2 shows a side view of the shoe storage system.
Figure 3:
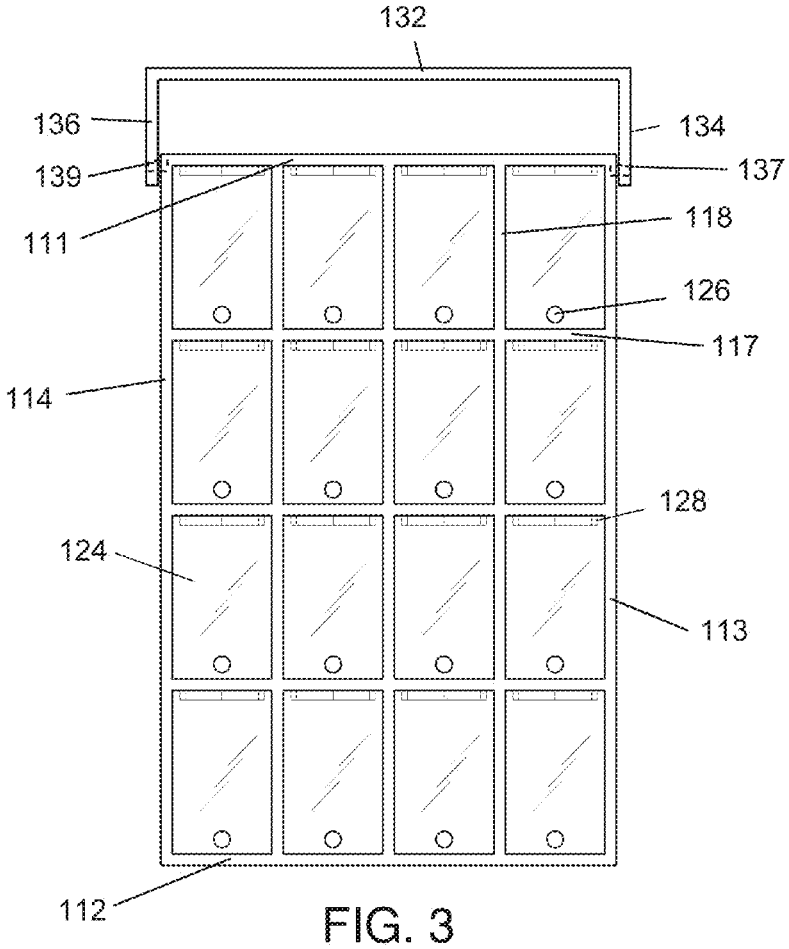
FIG. 3 shows a view of the shoe storage system.
Figure 4:
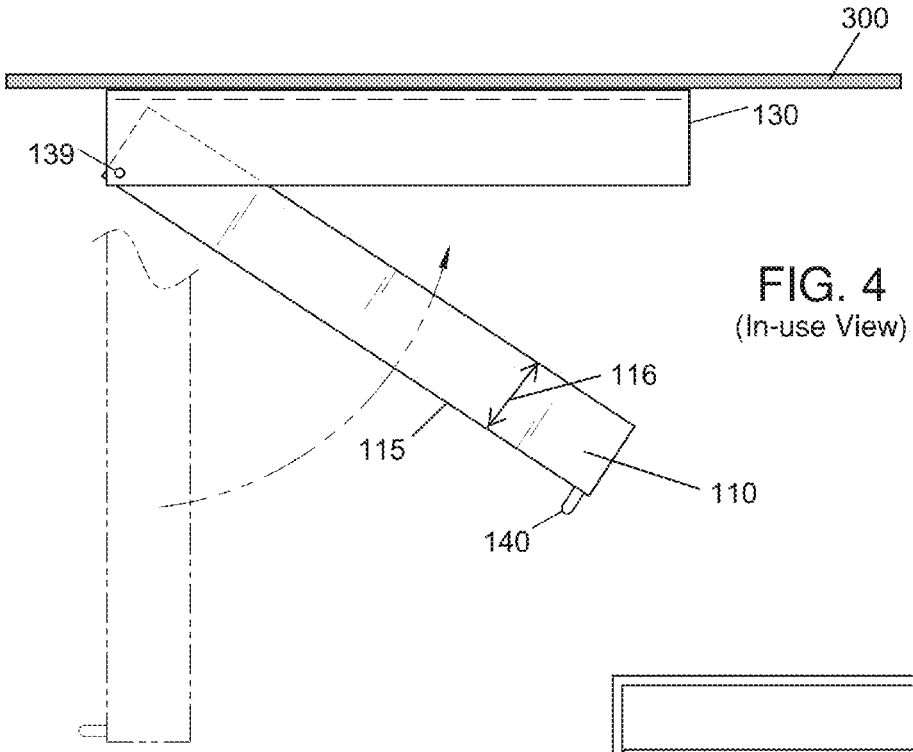
FIG. 4 shows an in-use view of the shoe storage system.
Figure 5:
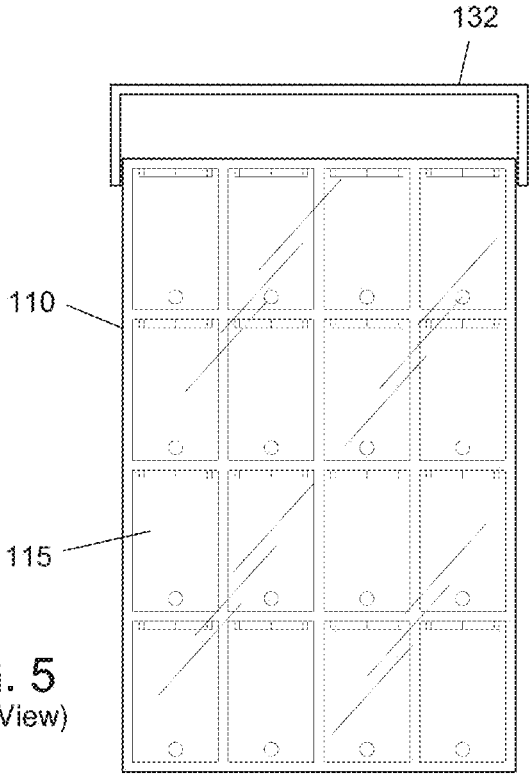
FIG. 5 shows a back view of the shoe storage system.

Referring now to FIGS. 1-5, the present invention features a shoe storage system (100) disposed on a ceiling or roof (300). The system comprises a multiple compartment shoe attic (110) and a mounting base (130). The mounting base has a base board (132) and two flanges. The base board is attached on a ceiling via a plurality of mounting rods through mounting holes (138). The shoe attic (110) is pivotably attached to the mounting base via two mounting hinges disposed on both flanges.

The multi-compartment shoe attic (110) has a top panel (111), a bottom panel (112), a first side panel (113), a second side panel (114) and a back side panel (115), wherein the top side, bottom side, first side and second side panels form a rectangle shape with two side panels perpendicular to both top and bottom panels, wherein the top side, bottom side, first side and second side panels have the same depth (116), wherein the back side panel covers the back side of said rectangle, wherein a plurality of horizontal ribs (117) and vertical ribs (118) are disposed within the said rectangle and separates the rectangle into multiple compartments (120), wherein the horizontal ribs (117) and vertical ribs (118) are perpendicular to each other.

The mounting base (130) has a base plate (132), a first flange (134) and a second flange (136), wherein a plurality of mounting holes (138) are disposed on the base plate (132), wherein the base plate (132) and two flanges form a U-shape opening adaptively to snuggly fit the shoe attic (110), wherein the first flange (134) and second flange (136) have a depth (141) equal to the depth (116) of the side panels of the shoe attic (110), wherein the shoe attic is pivotably connected to the mounting base via a first support hinge (137) and a second support hinge (139), wherein the first side panel (113) of the shoe attic is connected to the first flange (134) via the first support hinge (137) and the second side panel (114) of the shoe attic is connected to the second flange (136) via the second support hinge (139).

The base plate is securely attached to the ceiling via a plurality of screws (150) through the mounting holes (136) disposed on the base plate. The shoe attic (110) is pivotably attached to the mounting base between a storage position and an accessing position, wherein in storage position, the shoe attic is stored within the mounting base and held by at least one secure mean wherein in accessing position, the shoe attic is pivoted downwardly with the back panel (115) perpendicular to the ceiling (300). As used herein, "downwardly" is the direction from the ceiling towards the ground or earth.

In some embodiments, each compartment (120) has a compartment door (124) pivotably attached to the compartment (120) via a door hinge (128) disposed on the upper side of the compartment (120), In some embodiments, the compartment door is transparent or semi-transparent such that the user can view the shoes within the compartment without open the door thus saving searching time in some embodiments, the compartment door is made from acrylic, polycarbonate, Polymethyl methacrylate (PMMA). In some embodiments, a hole (126) is disposed on the compartment door for the convenience of opening the door.

In some embodiments, the back side panel (115) is transparent or semi-transparent such that the user can see all the shoes in the shoe attic before taking efforts to access the shoe attic in storage position within the mounting base on the ceiling. In some embodiments, the back side panel is made from acrylic, polycarbonate, Polymethyl methacrylate (PMMA).

In some embodiments, the shoe attic (110) further comprises a handle (140) disposed on the back side panel (115) near the bottom panel (112) such that a user can grab the handle and gradually pivot the shoe attic into the accessing position.

In some embodiments, the secure means is a L-shaped bracket (140) with a first arm (142) and second aim (144), wherein the first arm (142) is pivotably connected to the second flange (136) via a secure hinge (146), wherein the secure hinge (146) is disposed on the second flange (136) and on the opposite end to the second support hinge (139), wherein the second arm (144) is perpendicular to the first arm (142), wherein when the shoe attic (110) is in storage position, the bracket (140) is pivoted down with the second arm (144) supporting the back panel (115) of the shoe attic, wherein when the bracket (140) is pivoted up, the shoe attic is able to move toward the accessing position, In some embodiments, a second L-shaped bracket is attached to the first flange (134) with the same set up and provides additional support when the shoe attic is in storage position.

In some embodiments, all the compartments (120) have the same space by setting the horizontal and vertical ribs with equal spacing. In some embodiments, the compartments (120) have different space by setting the horizontal and vertical ribs with non-equal spacing to provide various spaces for different kinds of shoes such as boots, sandals, etc.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A shoe storage system (100) disposed on a ceiling (300) or wall or roof (200), the system consisting of:

(a) a multi-compartment shoe attic (110), wherein the attic has a top panel (111), a bottom panel (112), a first side panel (113), a second side panel (114) and a back side panel (115), wherein the top side, bottom side, first side and second side panels form a rectangle shape with two side panels perpendicular to both top and bottom panels, wherein the top side, bottom side, first side and second side panels have the same depth (116), wherein the back side panel covers the back side of said rectangle, wherein a plurality of horizontal ribs (117) and vertical ribs (118) are disposed within the said rectangle and separates the rectangle into multiple compartments (120), wherein each compartment (120) has a compartment door (124) pivotably attached to the compartment (120) via a door hinge (128) disposed on the upper side of the compartment (120), wherein the horizontal ribs (117) and vertical ribs (118) are perpendicular to each other;

(b) a mounting base (130) having a base plate (132), a first flange (134) and a second flange (136), wherein a plurality of mounting holes (138) are disposed on the base plate (132), wherein the base plate (132) and two flanges forms a U-shape opening adaptively to snuggly fit the shoe attic (110), wherein the first flange (134) and second flange (136) have a depth (141) equal to the depth (116) of the side panels of the shoe attic (110), wherein the shoe attic is pivotably connected to the mounting base via a first support hinge (137) and a second support hinge (139), wherein the first side panel (113) of the shoe attic is connected to the first flange (134) via the first support hinge (137) and the second side panel (114) of the shoe attic is connected to the second flange (136) via the second support hinge (139);

(c) the ceiling (300), wherein the base plate is securely attached to the ceiling via a plurality of screws (150) through the mounting holes (138) disposed on the base plate; and wherein the shoe attic (110) is pivotably attached to the mounting base between a storage position and an accessing position, wherein in storage position, the shoe attic is stored within the mounting base and held by at least one secure means, wherein in accessing position, the shoe attic is pivoted downwardly with the back panel (115) perpendicular to the ceiling (300).

* * * * *